US011591930B2

(12) United States Patent
Guillou et al.

(10) Patent No.: US 11,591,930 B2
(45) Date of Patent: Feb. 28, 2023

(54) ANNULAR ASSEMBLY FOR A TURBOMACHINE

(71) Applicant: SAFRAN AIRCRAFT ENGINES, Paris (FR)

(72) Inventors: Lancelot Guillou, Moissy-Cramayel (FR); Stéphane Louis Lucien Auberger, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 32 days.

(21) Appl. No.: 17/280,856

(22) PCT Filed: Sep. 25, 2019

(86) PCT No.: PCT/FR2019/052265
§ 371 (c)(1),
(2) Date: Mar. 26, 2021

(87) PCT Pub. No.: WO2020/065220
PCT Pub. Date: Apr. 2, 2020

(65) Prior Publication Data

US 2021/0404347 A1 Dec. 30, 2021

(30) Foreign Application Priority Data

Sep. 28, 2018 (FR) ..... 1859038

(51) Int. Cl.
*F01D 25/12* (2006.01)
*F01D 25/16* (2006.01)
*F01D 25/24* (2006.01)

(52) U.S. Cl.
CPC ..... *F01D 25/12* (2013.01); *F01D 25/16* (2013.01); *F01D 25/24* (2013.01);
(Continued)

(58) Field of Classification Search
CPC ..... F01D 25/12; F01D 25/16; F01D 25/24; F01D 25/246; F05D 2250/41; F05D 2260/213; F05D 2260/38; F05D 2300/121
See application file for complete search history.

(56) References Cited

U.S. PATENT DOCUMENTS 4,522,559 A 6/1985 Burge et al.
8,753,078 B2 * 6/2014 Speed ..... F01D 11/005 415/196

(Continued)

FOREIGN PATENT DOCUMENTS

EP 2 604 805 A2 6/2013

OTHER PUBLICATIONS

International Patent Application No. PCT/FR2019/052265, International Search Report and Written Opinion dated Feb. 3, 2020, 10 pgs.

*Primary Examiner* — Igor Kershteyn
(74) *Attorney, Agent, or Firm* — Lathrop GPM LLP

(57) ABSTRACT

The invention relates to an annular assembly for a dual-flow turbomachine having a longitudinal axis (A) and comprising a casing (12) with an annular shell (14), one face of which supports a piece of annular equipment, a plurality of means of attachment (18) for attaching the equipment to the annular shell (14) being distributed around the longitudinal axis (A) and allowing the equipment (16) a degree of freedom in the tangential direction relative to the annular shell (14), characterised in that each means of attachment (18) comprises a rail (20) integral with the annular equipment (16) and arranged radially between a first radially internal plate (22) and a second, radially external plate (24) and capable of sliding in the tangential direction between the first plate (22) and the second plate (24), and in that a removable support
(Continued)

element (56) is securely connected to the annular shell and to the first plate (22) and second plate (24).

19 Claims, 2 Drawing Sheets

(52) U.S. Cl.
CPC .... *F05D 2260/213* (2013.01); *F05D 2260/38* (2013.01); *F05D 2300/121* (2013.01)

(56) References Cited

U.S. PATENT DOCUMENTS

| | | | | |
|---|---|---|---|---|
| 9,453,429 | B2 * | 9/2016 | Danescu | F01D 25/26 |
| 9,896,971 | B2 * | 2/2018 | Richardson | F01D 25/246 |
| 2020/0392868 | A1 * | 12/2020 | Schleif | F01D 17/02 |
| 2021/0404347 | A1 * | 12/2021 | Guillou | F01D 25/16 |

* cited by examiner

ANNULAR ASSEMBLY FOR A TURBOMACHINE

CROSS-REFERENCE TO RELATED APPLICATIONS

This application is a 35 U.S.C. § 371 filing of International Application No. PCT/FR2019/052265 filed Sep. 25, 2019, which claims the benefit of priority to French Patent Application No. 1859038 filed Sep. 28, 2018, each of which is incorporated herein by reference in its entirety.

FIELD OF THE INVENTION

The present invention concerns the attachment of a heat exchanger carried by an annular part of a turbomachine.

BACKGROUND OF THE INVENTION

FIG. 1 represents a dual-flow turbomachine 10 comprising moving parts which rub against other moving parts or against fixed parts, this connection being, for example, a bearing. In order not to break due to heating caused by friction, the parts are sprayed with oil which firstly, limits (or contains) their heating and secondly, lubricates them to facilitate the sliding of the parts on top of each other.

The oil circulates in a circuit provided with heat exchangers, in particular oil/air exchangers 12, as shown in FIG. 2, having a matrix, in the form of a sinuous duct shaped so as to carry out an exchange of heat, in which the oil from said parts is introduced, then cooled, before being injected again on said parts. The heat exchanger 12 shown in FIG. 2 is an annular heat exchanger which is mounted on the radially internal or external face (relative to the longitudinal axis 14 of the turbomachine) of an annular shell 14 delimiting radially outwards or inside an annular flow path of a secondary air flow.

The hot oil can thus flow through the heat exchanger 12 and is cooled with the cold air from the annular flow path of the secondary air of the turbomachine. However, when the heat exchanger 12 is not made of the same material as the annular shell to which it is attached, it is noted that differences in expansion between the shell 14 and the material constituting the heat exchanger 12 can weaken the connections of the heat exchanger 12 to the shell. These differential expansions are all the greater the larger the size of the heat exchanger 12, which is generally the case when it is attached to the external annular shell. Differential expansions are also amplified by temperature differences between the annular shell 14 and the heat exchanger 12. These differential expansions lead to high mechanical stresses in the heat exchanger 12. It is therefore essential to take these differences in dilations into account. Furthermore, it is important to guarantee the easy mounting of the exchanger on the shell whilst preventing the elements used to attach the exchanger to the shell 14 from damaging the shell.

It should be noted that the problems set out above may arise with equipment other than a heat exchanger 12.

The invention particularly aims to provide a simple, effective and inexpensive solution to the above problems.

SUMMARY OF THE INVENTION

The present invention relates firstly to an annular assembly for a dual-flow turbomachine having a longitudinal axis and comprising a casing with an annular shell, one face of which supports a piece of annular equipment, a plurality of means for attaching the equipment to the annular shell being distributed around the longitudinal axis and allowing the equipment a degree of freedom in the tangential direction relative to the annular shell, characterised in that each means of attachment comprises a rail integral with the annular equipment and arranged radially between a first radially internal plate and a second, radially external plate and capable of sliding in the tangential direction between the first plate and the second plate, and in that a removable support element is securely connected to the annular shell and to the first plate and second plate.

According to the proposed configuration, each means of attachment comprises two plates integral with a removable support element fixed to the annular shell of the casing, which allows a pre-assembly of the first plate and the second plate to the heat exchanger to facilitate the subsequent addition of the support element. Thus, the mounting of the heat exchanger on the internal face of the annular shell of the casing is easier and does not require, when being assembled on the casing, the connection of the support element with the first and second plates to be taken into account, contrary to the previous technique where attaching the exchanger proved to be complicated.

The heat exchanger is supported by the casing shell by means of connections allowing deformation in the circumferential direction, which ensures optimum holding of the exchanger while allowing it to expand in the circumferential direction during operation. Indeed, the annular shell of the casing is made of a mechanically resistant material such as titanium, for example, which has a lower coefficient of thermal expansion (but it can also be equal to or higher) than that of the heat exchanger, which is made of a material, such as aluminium, which is structurally less resistant but whose coefficient of thermal expansion is generally, but not necessarily, higher. This situation is amplified by the temperature difference between the annular shell (rather cold because at air temperature) and the heat exchanger (rather hot because at oil temperature), which generates additional differential circumferential displacements.

This particular connection of the heat exchanger to the annular casing shell limits the radial movements of the exchanger which could lead to the exchanger shifting radially in the flow path, thus impacting the air flow. The rigid connection in the radial and axial directions ensures sufficient connection of the heat exchanger to the annular shell to ensure good transmission of vibrations to the casing structure, thus guaranteeing the service life of the heat exchanger.

The rail can comprise an opening with a closed outline internally delimited by at least two edges which are substantially tangential to each other in the longitudinal direction of the two first tangential faces of the first plate or the second plate and ensuring guidance of the rail in the tangential direction.

The said first tangential faces provide a sliding guide for the two circumferential edges of the rail. Thus, each means of attachment can slide in a tangential direction, thus ensuring a circumferential sliding of the exchanger.

Said two tangential faces are each formed on the first plate and are connected to two second tangential retaining faces radially inwardly of the rail, the first tangential faces forming with the second tangential faces an L-shaped cross-section.

This L-shape of two opposite edges of the first plate simultaneously provides guidance and retention radially inward.

The first plate comprises a central tubular portion tightly engaged in an orifice in the second plate.

The removable support element can comprise at least one rod integral with the first plate. In this configuration, the rod is fastened directly to the first plate, which allows the rail to remain radially restrained in all circumstances, unlike an attachment to the second plate.

The said rod can be a threaded rod screwed into the first plate and comprising a flat bearing surface on one face of the annular shell opposite that carrying the equipment.

Elastic means can be elastically constrained in the radial direction between the first plate and the rail. The elastic means thus make it possible to limit the sliding movement of the rail in relation to the shell. Thus, before assembly on the annular shell of the casing, the first plate and the second plate are blocked in a tangential direction on the rail, avoiding knocks or shocks that could damage the various parts.

The first plate can comprise a housing for receiving elastic means, such as a wave washer.

The outline comprises a convex edge delimiting a part of the rail used for the radial support of the elastic means.

The annular shell can be an external annular shell of an annular flow path of a secondary air flow, the equipment being carried by a radially internal face of the external shell.

The invention is of particular interest when the equipment is a heat exchanger made of a material, such as for example aluminium, having a higher coefficient of thermal expansion than the material, such as titanium, of the casing shell.

The invention also relates to a method of mounting the above-mentioned assembly in which:

- for each of the first attachments, the rail is arranged between the first and second plates fastened to each other, the rail being made integral with a radially external face of the heat exchanger, then
- the assembly carried out in the previous step is presented opposite the radially internal face of the annular shell and the support elements are secured to one of the first plate and the second plate.

The invention will be better understood and other details, characteristics and advantages of the invention will appear when reading the following description, which is given as a non-limiting example, with reference to the attached drawings.

DETAILED DESCRIPTION

Figure 1:
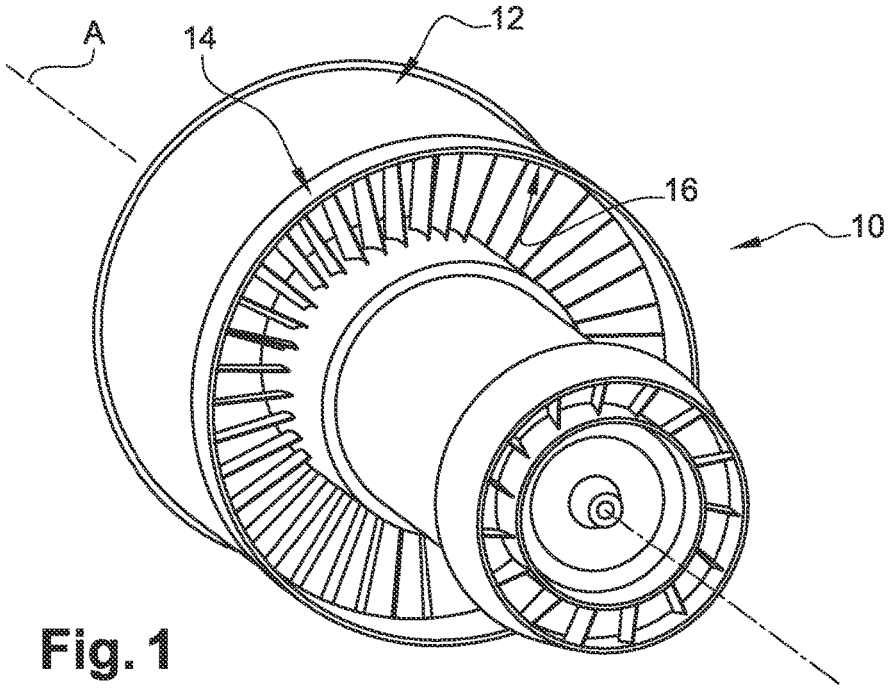
FIG. 1, already described above, is a schematic perspective view of a turbomachine according to the prior art.
Figure 2:
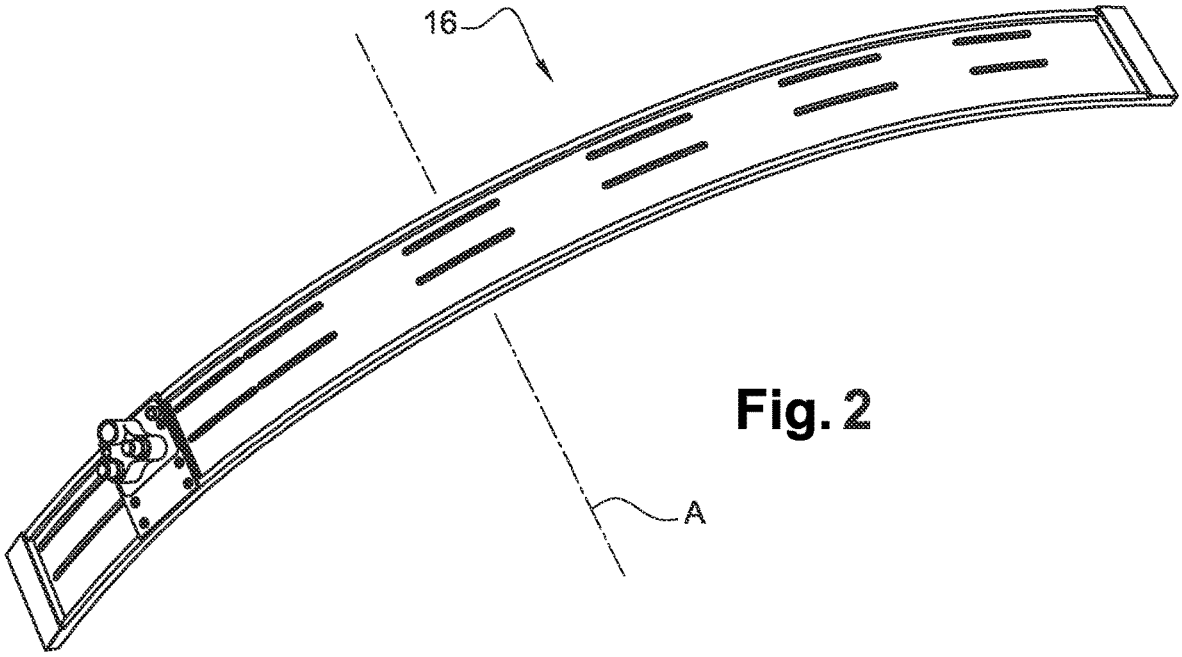
FIG. 2, already described above, is a schematic perspective view of a portion of an annular heat exchanger mounted in the turbomachine of FIG. 1.
Figure 3:
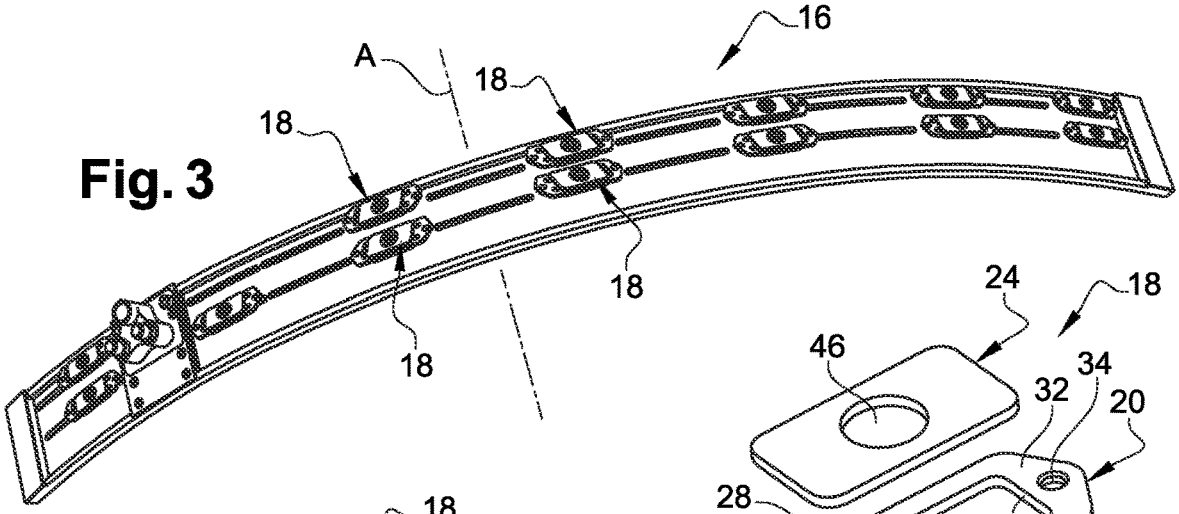
FIG. 3 is a schematic perspective view of a heat exchanger according to the invention comprising means of attachment with a degree of freedom in the tangential direction.

FIG. 3 shows an annular equipment for the turbomachine. This equipment 16 is a heat exchanger and the invention will be described below in relation to this specific piece of equipment but is also applicable to other equipment.

The body of the heat exchanger 16 is usually made by extrusion of a good heat-conducting material such as aluminium. With such a process, it is thus possible to make the ducts in the thickness of the exchanger 16. Only a portion of the angular sector of exchanger 16 is shown in FIG. 3. This heat exchanger 16 comprises internal ducts for the circulation of oil to be cooled. The circumferential ends of the exchanger 16 have inserts that allow oil recirculation.

Figure 5:
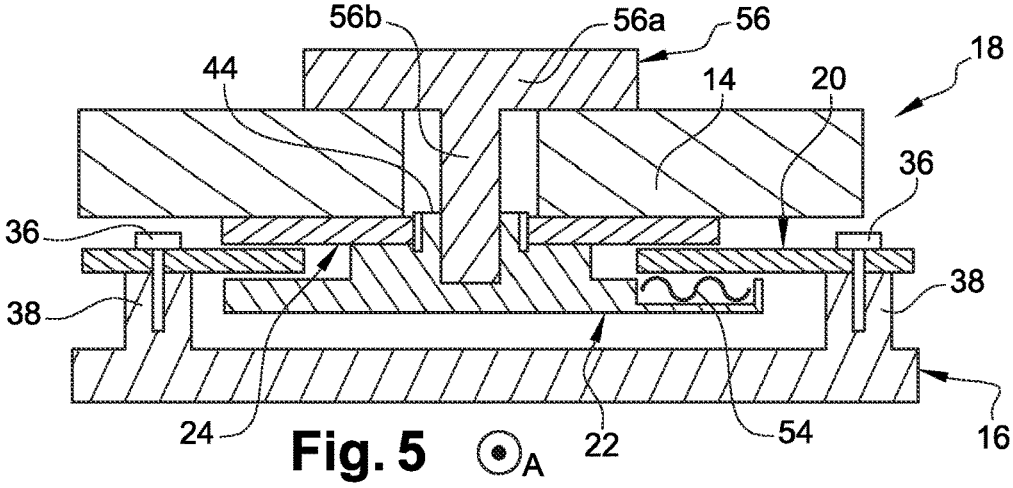
FIG. 5 is a schematic sectional view of the means of attachment, the heat exchanger and an annular shell of a casing according to the sectional plane W of FIG. 4A (shown on 3 or 4A of the sectional plane)

The exchanger 16 comprises a plurality of means of attachment 18 for attaching the exchanger 16 to the external annular shell 14 which is shown in FIG. 5. It should be noted immediately that the exchanger 16 can be attached to an internal annular casing shell without the need for a new description so that it is understood that what applies to the external annular shell 14 also applies to an internal annular shell.

The means of attachment 18 of the heat exchanger 16 are distributed around the circumference of the heat exchanger 16, i.e. around the longitudinal axis A of the turbomachine. FIG. 3 shows two annular rows of means of attachment 18.

As will be explained in the following, each means of attachment 18 allows a connection with one degree of freedom in the tangential direction of the heat exchanger 16 with the external annular shell 14. Thus, each means of attachment 18 comprises a rail 20 integral with the heat exchanger 16 and inserted radially between a first plate 22 and a second plate 24.

The rail 20 has a substantially rectangular shape with an internal opening 26 which is closed in outline. This rail 20 thus comprises two rectilinear uprights 28 which are oriented in a tangential direction and are connected to each other by a first end section 30 and a second end section 32. The first end section 30 and the second end section 32 each comprise an orifice 34 for a fastening screw 36 to secure the rail 20 to radially external bosses 38 of the heat exchanger 16 (FIG. 5). The first end section 32 of the rail 20 also comprises a section 40 forming a tongue extending inwardly into the opening 26. More specifically, the outline of the opening 26 is delimited by two tangential parallel edges 26*a*, 26*b* of which a first edge 26*a* is formed on a first straight upright 28 and a second edge 26*b* is formed on a second straight upright 28, by a longitudinal edge 26*c* and by a convex curved edge 26*d* tangentially opposite the longitudinal edge 26*c*. This convex edge 26*d* is connected to the ends of the longitudinal edges 26*a*, 26*b* and, together with these, delimit two slots 42 with the external outline of the tongue 40.

The first plate 22 also has an approximately rectangular shape. It has a central tubular portion 44 passing through the opening 26 of the rail 20. This tubular portion 44 is tightly engaged in an orifice 46 of the second plate 24. The first plate 22 comprises two parts extending tangentially to an L-shaped section 48 formed on either side of the tubular portion 44 and each formed by a first tangential face 48*a* and a second tangential face 48*b*. The first tangential faces 48*a* are longitudinally opposed to the first 26*a* and second 26*b* edges of the outline of the opening 26 of the rail 20 so as to allow tangential guiding of the rail 20. The second tangential faces 48*b* provide a radially inward retention of the rail 20 on the first plate 22.

Figure 4A:
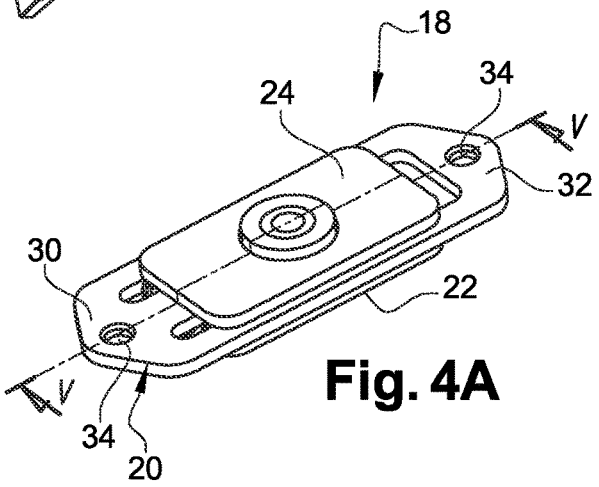
FIG. 4A is a schematic perspective view of the main element of the means of attachment according to the invention.
Figure 4B:
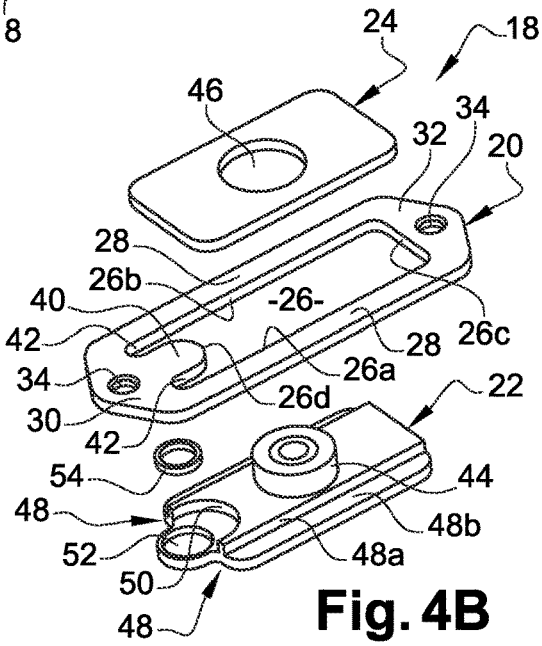
FIG. 4B is a schematic perspective view of the main element of the means of attachment according to the invention.
Figure 6:
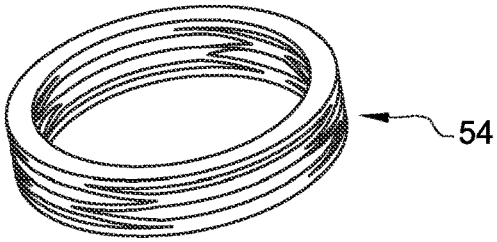
FIG. 6 is a schematic view, in perspective, of a turbine engine blade Performance according to the invention.

As can be seen in FIG. 4B, the first plate 22 comprises an end portion with a concave curved edge 50 facing the convex curved edge of the tongue 40 of the rail 20. The end portions of the concave curved edge 50 are designed to fit into the above-mentioned slots 42 of the rail 20, thus improving the compactness of each means of attachment 18. One tangential end of the first plate 22 comprises a housing 52 in which are mounted elastic means 54 capable of elastic deformation in the radial direction. These elastic means 54 are for example a wave washer as shown in FIG. 6. They can be elastically prestressed during the mounting between the first plate 22 and rail 20, here more specifically the tongue 40 of the rail 20.

Note that the first plate 22 has a longitudinal dimension greater than the longitudinal dimension of the opening of the rail 20 (FIGS. 4A and 4B). More specifically, the rectilinear uprights 28 of the rail 20 are able to slide on the second plate 24 on either side of its orifice 46 for mounting the tubular portion 44 of the first plate 22.

Although not shown, the first 48*a* tangential sliding guide faces of the first 26*a* and second 26*b* edges of the rail 20 could be formed on the second plate 24.

As can be seen in FIG. 5, a removable support element 56 is mounted on the annular shell 14 and comprises a flat 56*a* bearing on the radially external face of the external annular shell 14 and a rod 56*b* screwed into the tubular portion 44 of the first plate 22. When so mounted, the first plate 22 and the second plate 24 are fastened integrally to the external annular shell 14.

Each of the means of attachments 18 with a tangential degree of freedom 18 is mounted as follows:

- the rail 20 is arranged between the first plate 22 and the second plate 24 fastened to each other, the rail 20 being made integral with a radially external face of the heat exchanger 16, then
- the assembly carried out in the previous step is presented opposite the radially internal face of the external annular shell 14 and the support elements 56 are secured to one of the first plate 22 and the second plate 24.

With such an assembly, each means of attachment is pre-assembled at heat exchanger 16, which simplifies the mounting of heat exchanger 16 on the external annular shell 14. In addition, the elastic means 54 prevent the untimely movements of the first 22 and second 24 plates since the first plate 22, which is attached to the second plate 24, is blocked on the rail 20.

The invention claimed is:

1. An annular assembly for a dual-flow turbomachine having a longitudinal axis and comprising a casing with an annular shell, one face of which supports a piece of annular equipment, a plurality of means of attachment for attaching the equipment to the annular shell being distributed around the longitudinal axis and allowing the equipment a degree of freedom in the tangential direction relative to the annular shell, characterised in that each means of attachment comprises a rail integral with the annular equipment and arranged radially between a first radially internal plate and a second radially external plate and capable of sliding in the tangential direction between the first plate and the second plate, and in that a removable support element is securely connected to the annular shell and to the first plate and second plate, wherein the annular shell is an external annular shell of an annular flow path of a secondary air stream, the equipment being carried by a radially internal face of the external shell and wherein the equipment is a heat exchanger made of a material having a coefficient of thermal expansion greater than that of a material of the casing shell.

2. An assembly according to claim 1, in which the rail comprises an opening with a closed outline delimited internally by at least two edges which are substantially tangential in relation to each other in the longitudinal direction of first two tangential faces of the first plate or of the second plate and ensuring the guiding of the rail in the tangential direction.

3. An assembly according to claim 2, wherein said two first tangential faces are each formed on the first plate and are connected to two second tangential retaining faces radially inward of the rail, the two first tangential faces forming, with the two second tangential faces, an L-shaped section.

4. An assembly according to claim 2, wherein the two first tangential faces and/or the two second tangential faces are formed on the first plate.

5. An assembly according to claim 3, wherein the two first tangential faces and/or the two second tangential faces are formed on the first plate.

6. An assembly according to claim 1, wherein the first plate comprises a central tubular portion tightly engaged in an orifice of the second plate.

7. An assembly according to claim 2, wherein the first plate comprises a central tubular portion tightly engaged in an orifice of the second plate.

8. An assembly according to claim 3, wherein the first plate comprises a central tubular portion tightly engaged in an orifice of the second plate.

9. An assembly according to claim 4, wherein the first plate comprises a central tubular portion tightly engaged in an orifice of the second plate.

10. An assembly according to claim 1, wherein the removable support element comprises at least one rod integral with the first plate.

11. An assembly according to claim 2, wherein the removable support element comprises at least one rod integral with the first plate.

12. An assembly according to claim 3, wherein the removable support element comprises at least one rod integral with the first plate.

13. An assembly according to claim 10, wherein the said rod is a threaded rod screwed into the first plate and comprising a flat bearing on a face of the annular shell opposite that carrying the equipment.

14. An assembly according to claim 1, in which elastic means are elastically constrained in the radial direction between the first plate and the rail.

15. An assembly according to claim 14, wherein the first plate comprises a housing for receiving elastic means, such as for example a wave washer.

16. An assembly according to claim 2, wherein the outline comprises a convex edge delimiting a part of the rail serving for the radial support of the elastic means.

17. An assembly according to claim 14, wherein the outline comprises a convex edge delimiting a part of the rail serving for the radial support of the elastic means.

18. An assembly according to claim 1, wherein the heat exchanger made of aluminium and the casing shell is made of titanium.

19. Method for mounting the assembly according to claim 1, in which:

- for each of the first means of attachment, the rail is arranged between the first plate and the second plate fastened to each other, the rail being made integral with a radially external face of the heat exchanger, then the assembly carried out in the preceding step is presented opposite the radially internal face of the annular shell and the support elements are secured to one of the first plate and the second plate.

* * * * *